US006460457B1

(12) United States Patent
Ramsay

(10) Patent No.: US 6,460,457 B1
(45) **Date of Patent: *Oct. 8, 2002**

(54) METHOD AND DEVICE FOR AUTOMATICALLY PROVIDING A PRINTING PLATE TO A PLATE CYLINDER

(75) Inventor: Bertrum Scott Ramsay, Wolfeboro, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,801

(22) Filed: Nov. 22, 1999

(51) Int. Cl.[7] ..... B41F 21/00; B41F 1/28

(52) U.S. Cl. ..... 101/477; 101/415; 101/378; 101/481

(58) Field of Search ..... 101/477, 415.1, 101/378, 485

(56) References Cited

U.S. PATENT DOCUMENTS

| | | | | |
|---|---|---|---|---|
| 5,284,093 A | | 2/1994 | Guaraldi et al. | 101/415.1 |
| 5,383,402 A | * | 1/1995 | Takano et al. | 101/415.1 |
| 5,390,603 A | | 2/1995 | Hauck et al. | 101/485 |
| 5,443,006 A | * | 8/1995 | Beisel et al. | 101/477 |
| 5,479,859 A | * | 1/1996 | Lindner et al. | 101/485 |
| 5,495,805 A | * | 3/1996 | Beisel et al. | 101/477 |
| 5,526,747 A | | 6/1996 | Marmin et al. | 101/477 |
| 5,553,544 A | | 9/1996 | Ramsay | 101/415.1 |
| 5,555,812 A | * | 9/1996 | Ruckmann et al. | 101/477 |
| 5,595,119 A | | 1/1997 | Hada et al. | 101/477 |
| 5,678,487 A | | 10/1997 | Guaraldi et al. | 101/415.1 |
| 5,701,822 A | | 12/1997 | Métrope | 101/477 |
| 5,709,150 A | | 1/1998 | Duerr et al. | 101/415.1 |
| 5,715,752 A | * | 2/1998 | Rother et al. | 101/415.1 |
| 5,758,579 A | | 6/1998 | Marmin et al. | 101/486 |

FOREIGN PATENT DOCUMENTS

| | | |
|---|---|---|
| EP | 0678382 | 10/1995 |
| EP | 0678383 | 5/1998 |
| WO | 9519262 | 7/1995 |

* cited by examiner

*Primary Examiner*—Andrew H. Hirshfeld
*Assistant Examiner*—Marvin P Crenshaw
(74) *Attorney, Agent, or Firm*—Davidson, Davidson & Kappel, LLC

(57) ABSTRACT

A method for automatically providing a printing plate to a plate cylinder includes the steps of aligning a first edge of a printing plate against a cylinder adjacent to a plate cylinder, moving the first edge of the printing plate into a gap in the plate cylinder, and wrapping the printing plate about the plate cylinder. The present invention also includes a device for attaching a printing plate to a plate cylinder comprising a first set of grippers for gripping a printing plate and aligning the printing plate against a cylinder adjacent to the plate cylinder, and a second set of grippers for moving the printing plate toward a gap in the plate cylinder. An offset printing press having the device is also disclosed.

18 Claims, 10 Drawing Sheets

METHOD AND DEVICE FOR AUTOMATICALLY PROVIDING A PRINTING PLATE TO A PLATE CYLINDER

BACKGROUND OF THE INVENTION

1. Field of the Invention

The present invention relates generally to printing presses and more particularly to a method and device for providing a printing plate to a plate cylinder during an automatic plate change operation.

2. Background Information

U.S. Pat. No. 5,390,603 discloses a method for automatic changing of printing plates on a plate cylinder of a printing press. The plate cylinder has a locking or clamping device for a lead edge and trail edge of the printing plate. To change the printing plates, the plate cylinders are driven to a release position and the trail edge of the plates is released. The plate cylinders are then turned in the opposite direction to unwind the printing plates. A new plate for each cylinder is then fed in by suction arms which hold the plate so that the lead edge of the new plate can be attached to the lead edge locking device.

U.S. Pat. Nos. 5,495,805 and 5,443,006 disclose devices for carrying away and supplying printing plates to a plate cylinder. In these patents, a magazine has two holding shafts into which cassettes are insertable from above. One cassette is originally empty and can receive used printing plates, while the other holds new printing plates to be attached to the plate cylinder. A plate supplying apparatus takes plates from the new plate cassette and a plate removing apparatus removes the plates from the plate cylinder and places them in the old plate cassette. The plate removing apparatus includes suction elements disposed in a first carriage movable by a driving apparatus along a first guide. To remove the plate, the rear-edge clamping device of the plate cylinder is released, so that the inherent elasticity of the printing plate causes the rear edge of the printing plate to bump against a guide roller. The plate cylinder is then rotated backwardly so that the plate is inserted into the magazine, where the suction elements are activated and, simultaneously with a further backward rotation of the plate cylinder, the first carriage with the suction elements moves the old printing plate into an upper position, the lead edge having also been released. The old plate is then placed in the old plate cassette. To supply a new plate, the plate supplying apparatus has suction elements on a second carriage. The lead edge of the new printing plate is carried to the front-edge clamping device of the plate cylinder. The plate is aligned and clamped. The plate cylinder is rotated in the forward direction, pulling the printing plate onto its outer cylindrical surface. Due to a weakened vacuum of the suction elements, the printing plate still can be held by the suction elements while sliding over the suction elements sue to the plate cylinder rotation. Before the printing plate trail edge passes the last two suction elements, the suction elements are deactivated and a pressing-in roller presses the trail edge radially into the trail-edge clamping device. The trail edge is clamped and the plate tensioned.

U.S. Pat. No. 5,701,822 discloses a device for changing printing plates on an offset printing press. The plate cylinder has an automatic clamping device in a gap or channel of the plate cylinder. A holding element to aid in position of the printing plate on the plate cylinder is provided, as is a printing plate loading unit, which holds a printing plate to be loaded. The holding element grips a plate to be inserted and positions the lead edge against the plate cylinder. As the plate cylinder rotates, the lead edge slips into the gap or channel and is clamped by the automatic clamping device. The printing form then can be tautly wrapped around the circumference of the plate cylinder and the trail edge fastened therein, aided by a roller.

A problem with the devices and methods described above is that the lead edge of the plate may skew or become misaligned with the plate gap before insertion. This skew or misalignment can cause malfunction of an automatic plate device. Especially when used with very small gap plate cylinders, the above methods and devices are prone to malfunction or cannot be used at all.

U.S. Pat. Nos. 5,553,544 and 5,284,093 show small gap plate cylinders, where the trail and lead edges of the plate are inserted into the same gap so that only a small space separates them. U.S. Pat. No. 5,678,487 also shows a small gap plate cylinder and discloses a tucking device for the trail edge. These three patents, as well as U.S. Pat. Nos. 5,495,805 and 5,443,006 discussed above, are hereby incorporated by reference herein.

BRIEF SUMMARY OF THE INVENTION

An object of the present invention is to provide an improved method for automatically attaching printing plates to a plate cylinder. An additional object is to provide an improved device for providing a printing plate to the plate cylinder.

The present invention provides a method for automatically providing a printing plate to a plate cylinder including the steps of aligning a first edge of a printing plate against a cylinder adjacent to a plate cylinder, moving the first edge of the printing plate into a gap in the plate cylinder, and wrapping the printing plate about the plate cylinder.

The present method provides for better alignment of the plate before insertion into a gap in the plate cylinder. The lead edge of the plate thus more reliably fits into the gap in proper alignment. Thus with even small gapped plate cylinders, the plate can be inserted more reliably.

The present method further may include the step of fastening the first edge in the gap. The plate cylinder may then be rotated to wrap the plate about the plate cylinder. A tucking device may then be used to aid in inserting the trail edge of the plate into the gap.

Preferably, the adjacent cylinder is a blanket cylinder of an offset printing press. The blanket cylinder advantageously provides a large adjacent surface on which to align the plate.

The present invention also provides a method for attaching a printing plate to a plate cylinder comprising the steps of holding a printing plate through a first set of grippers, moving the first set of grippers so that a lead edge of the plate aligns against a cylinder adjacent to the plate cylinder, holding the printing plate through a second set of grippers, releasing the fist set of grippers, moving the second set of grippers toward a gap in the plate cylinder, and inserting the lead edge of the printing plate into the gap.

The present invention also provides a device for attaching a printing plate to a plate cylinder having a first set of grippers for gripping a printing plate and aligning the printing plate against a cylinder adjacent to the plate cylinder and a second set of grippers for moving the printing plate toward a gap in the plate cylinder.

Advantageously, the first set of grippers includes spring-mounted grippers, so that the plate may align against the adjacent cylinder. The first set of grippers preferably moves in a direction solely radial to the adjacent cylinder. The second set of grippers preferably is movable in a direction substantially radial to the plate cylinder.

The device may further include a tucking device for tucking in the trail edge of the printing plate.

The present invention also provides an offset printing press having a plate cylinder with a plate locking mechanism and having a receiving gap on an outer surface, a blanket cylinder forming a nip with the plate cylinder; and a plate attachment device having a first set of grippers for gripping a printing plate and aligning the printing plate against the blanket cylinder and a second set of grippers for moving the printing plate toward the receiving gap.

BRIEF DESCRIPTION OF THE DRAWINGS

One preferred embodiment of the present invention is described below by reference to the following drawings, in which.

DETAILED DESCRIPTION

Figure 1:
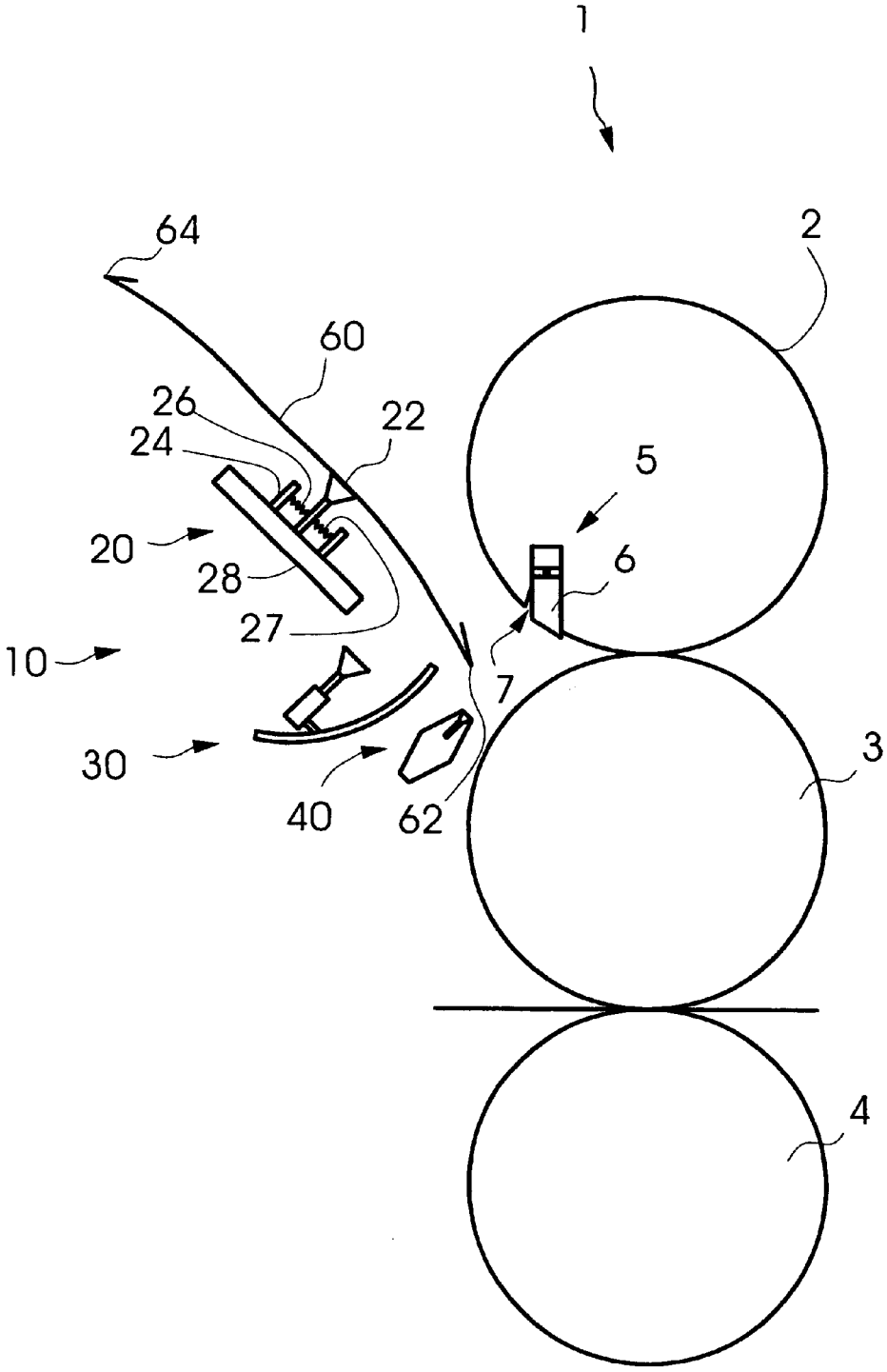
FIG. 1 shows a side view of the device of the present invention with the plate being held by the first gripper set.

FIG. 1 shows a schematic side view of plate attachment device 10, which includes a first gripper set 20, a second gripper set 30 and a tucking device 40. The plate attachment device is located next to an offset printing unit 1, which includes a plate cylinder 2, an adjacent upper blanket cylinder 3 and a lower blanket cylinder 4. A plate locking device 5 is located in a channel at the surface of plate cylinder 5 and moves a plate clamp 6 toward or away from the surface of plate cylinder 5. The locking mechanism may be similar, for example, to those disclosed in U.S. Pat. Nos. 284,093, 5,553,544, and 678,487. A gap 7 is formed between the channel side wall and plate clamp 6, for accepting a lead edge 62 and a trail edge 64 of a printing plate 60.

First gripper set 20 includes at least a first gripper 22, which is held in a gripper holder 24 between a first spring 26 and a second spring 27. The first gripper set 20 is movable in a track 28 and can grip plate 60 using, for example, suction. The first gripper 22 moves in track 28 so that plate 60 moves radially with respect to blanket cylinder 3. First gripper 22 is held by springs 26 and 27 such that first gripper 22 is slightly flexible radially in the direction of springs 26 and 27, but are stable or fixed axially, i.e. into the page as shown in FIG. 1, and tangentially to blanket cylinder 3. The grippers may be provided with a suction force through a vacuum device and a flexible tube connected to the grippers. The suction grippers may be similar generally to the suction pads disclosed in U.S. Pat. No. 5,443,006, for example.

Figure 7:
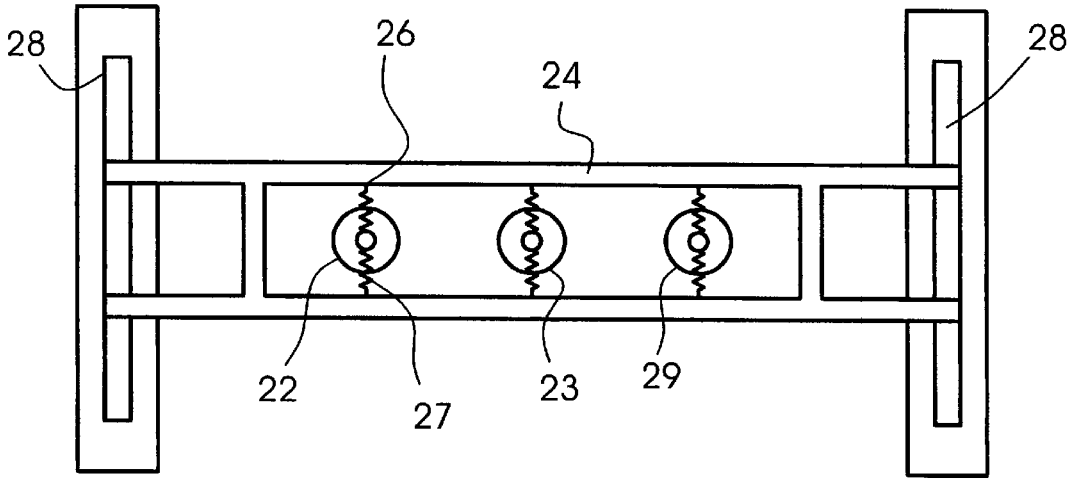
FIG. 7 shows a cross-sectional view of a possible configuration of the first gripper set of the present invention.

FIG. 7 shows a cross-section view of first gripper set 20 and shows that gripper set 20 may comprise, for example, a plurality of grippers (shown by dotted lines) 22, 23 and 29, held between springs. Gripper holder 24 may be an H-bar, for example, moving in track 28. Toothed wheels run by a motor may, for example, drive gripper holder 24. However, as defined herein a gripper set may also include a single gripper.

Figure 2:
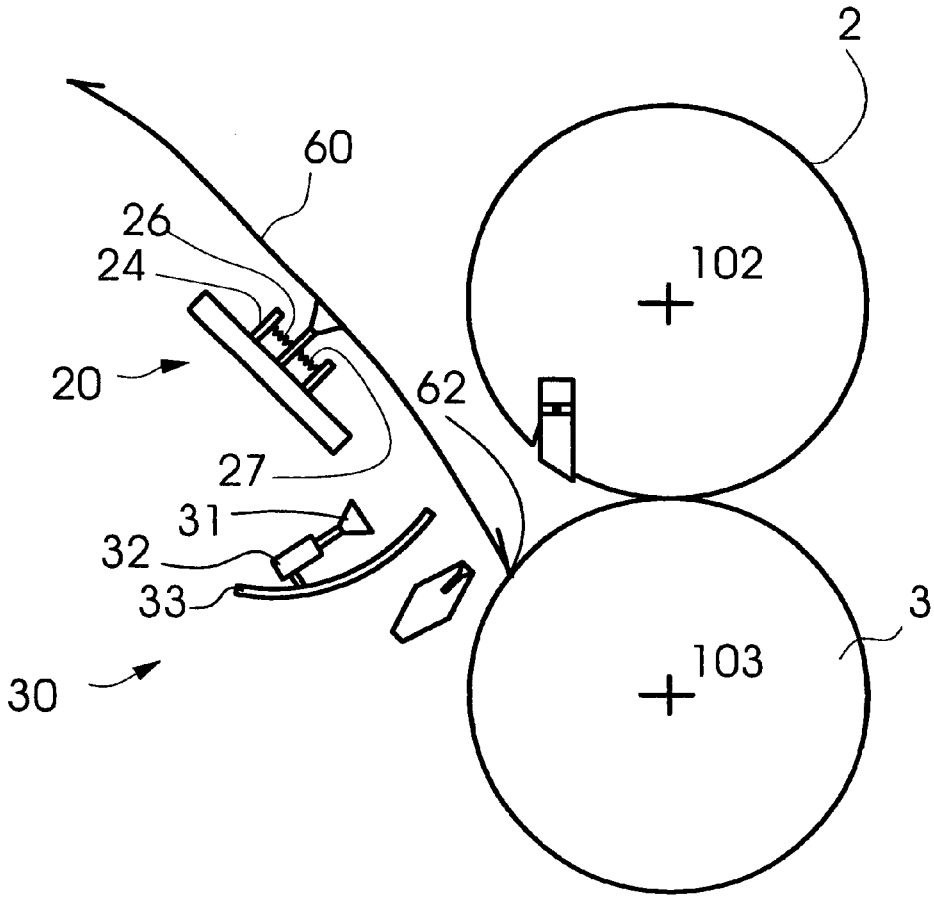
FIG. 2 shows a side view of the device of the present invention with the plate aligned on the blanket cylinder.

As shown in FIG. 2, once plate 60 has been gripped by first gripper set 20, gripper holder 24 is moved radially toward blanket cylinder 3 so that the entirety of lead edge 62 contacts blanket cylinder 3. Any skew or misalignment of lead edge 62 with respect to blanket cylinder 3 is corrected, as the springs 26 and 27 permit lead edge 62 to align with the surface of blanket cylinder 3. Lead edge 62 thus also is aligned properly with respect to plate cylinder 2, which is coaxial with blanket cylinder 3. Lead edge 62, axis 102 of plate cylinder 2 and axis 103 of blanket cylinder 3 therefore all are parallel to each other.

Second gripper set 30, having a gripper 31, a second gripper holder 32 and a track 33 is then moved to grip plate 60 in its properly aligned position. Gripper set 30 thus firmly grips, through for example suction, plate 60 in its aligned position. First gripper set 20 then is released by removing the suction, or by providing a positive air flow.

Figure 3:
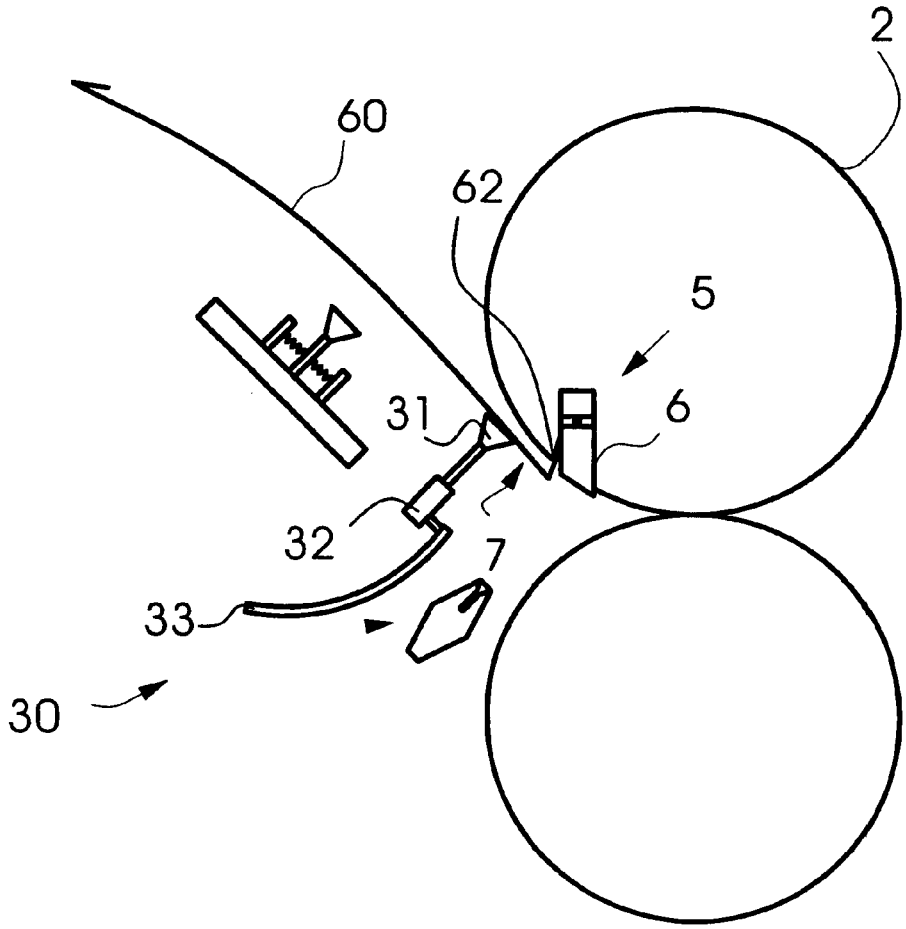
FIG. 3 shows a side view of the device of the present invention with the plate being held by the second gripper set and moved into the gap of the plate cylinder.

As shown in FIG. 3, gripper holder 32 then moves in track 33 so that lead edge 62 of plate 60 fits into gap 7 next to unlocked locking mechanism 5 of plate cylinder 2, which is in an initial insertion position. Advantageously, track 33 may be curved to aid in providing a proper insertion angle. As an alternative to this insertion method, track 33 may be shaped so that the lead edge 62 first hits against the surface of lock-up clamp 6 so that plate 60 bends backwardly so as to create a slight spring force. Plate 60 is then moved upwardly along the surface of lock-up clamp 6 and springs into gap 7.

Figure 4:
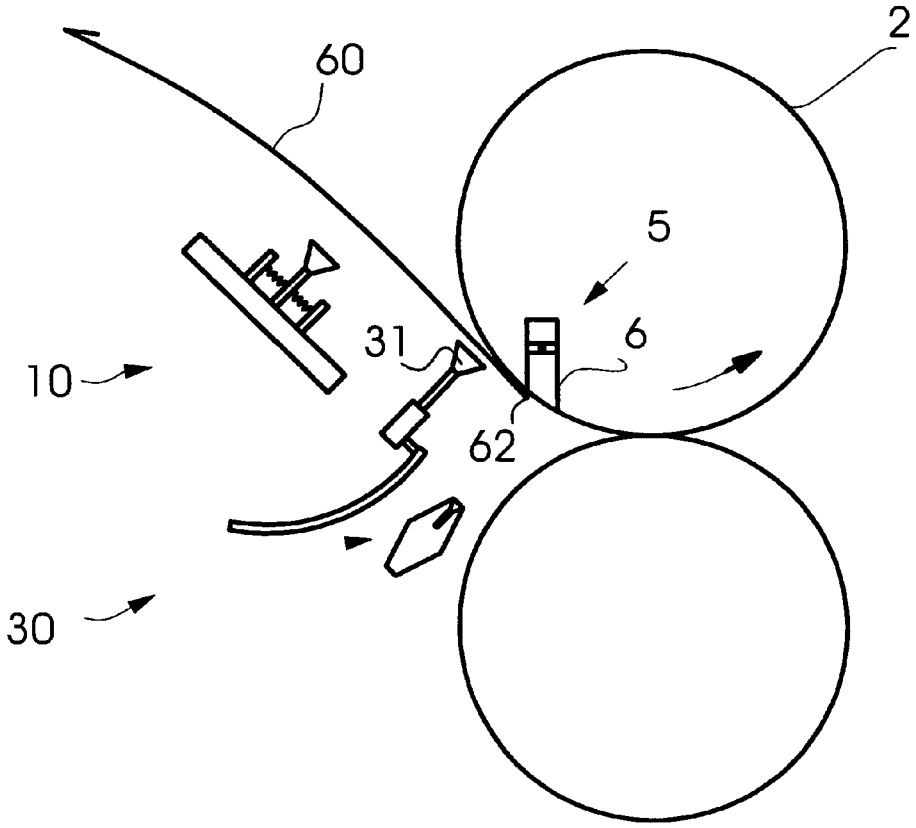
FIG. 4 shows a side view of the device of the present invention with the plate inserted into the gap and the plate locking device closed for rotation.

Grippers 31 preferably are spring-supported in an axial direction, i.e. in and out of the page in FIGS. 2, 3 and 4. The entire second gripper set 30 is movable as well in the axial direction, for example by providing a linear driver for track 33 in an axial direction. Once plate 60 is inserted in gap 7, second gripper set 30 is moved axially so as to push the plate against an axial plate stop to provide proper axial alignment.

Suction is then removed, or a positive air flow provided, to release plate 60 from second gripper set 30. Lock-up mechanism 5 is then locked. Plate 60 is thus fixed in gap 7 in proper alignment. Plate 2 may then be rotated in the direction of the arrow in FIG. 4.

Figure 5:
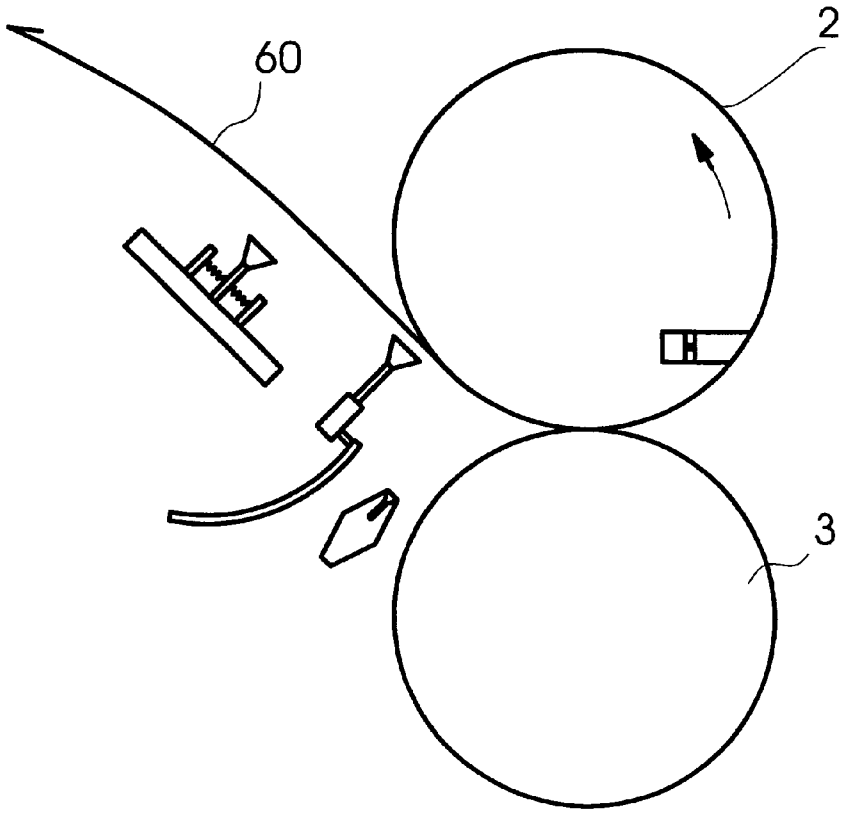
FIG. 5 shows a side view of the device of the present invention with the plate being rotated through the plate-blanket nip.
Figure 6:
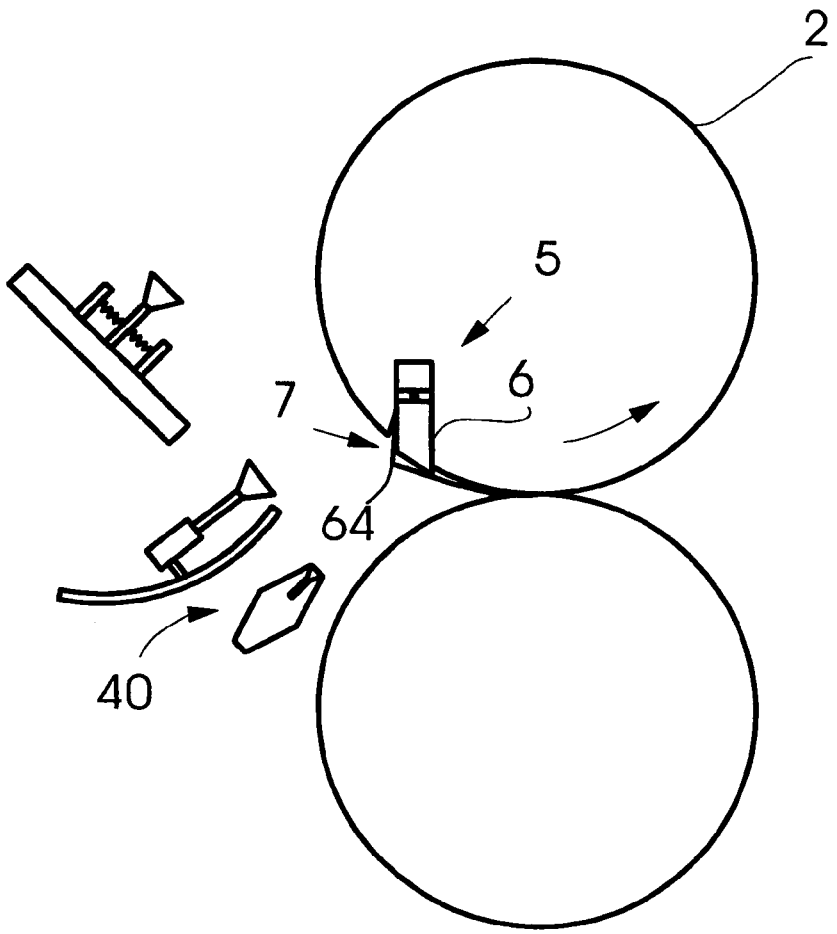
FIG. 6 shows a side view of the device of the present invention with the trail edge of the plate being tucked into the plate cylinder gap.

As shown by FIG. 5, plate 60 is thus pulled through the plate cylinder-blanket cylinder nip and may additionally be supported by deactivated gripper 31. Alternately, gripper 31 may be withdrawn if the stiffness in the plate permits that plate 60 will not be damaged by any components of attachment device 10.

When plate cylinder 2 returns to its original insertion position, trail edge 64 is ready to be tucked into gap 7. Locking mechanism 6 is activated so that clamp 6 moves away from the surface of plate cylinder 2. Tucking device 40, which may be, for example, similar to the tucking device disclosed in U.S. Pat. No. 5,678,487, can then be activated to tuck trail edge 64 into gap 7. Clamp 6 is retracted and tucking mechanism 40 deactivated. Plate 60 is thus firmly attached to plate cylinder 2.

Removal of the plate after use can be effected in a variety of ways be releasing the trail edge, and using an automatic deplating device, for example on the other side of plate cylinder 2, or by using plate attachment device 10 to guide the plate off the plate cylinder.

As an alternative to the two separate gripper movement mechanisms shown in FIG. 1, it is also possible to provide the second gripper set on gripper holder 24 shown in FIG. 7. The gripper holder 24 as shown in FIG. 1 could then be rotated upwardly to provide insertion of the plate, after the alignment with the blanket has occurred.

Figure 8:
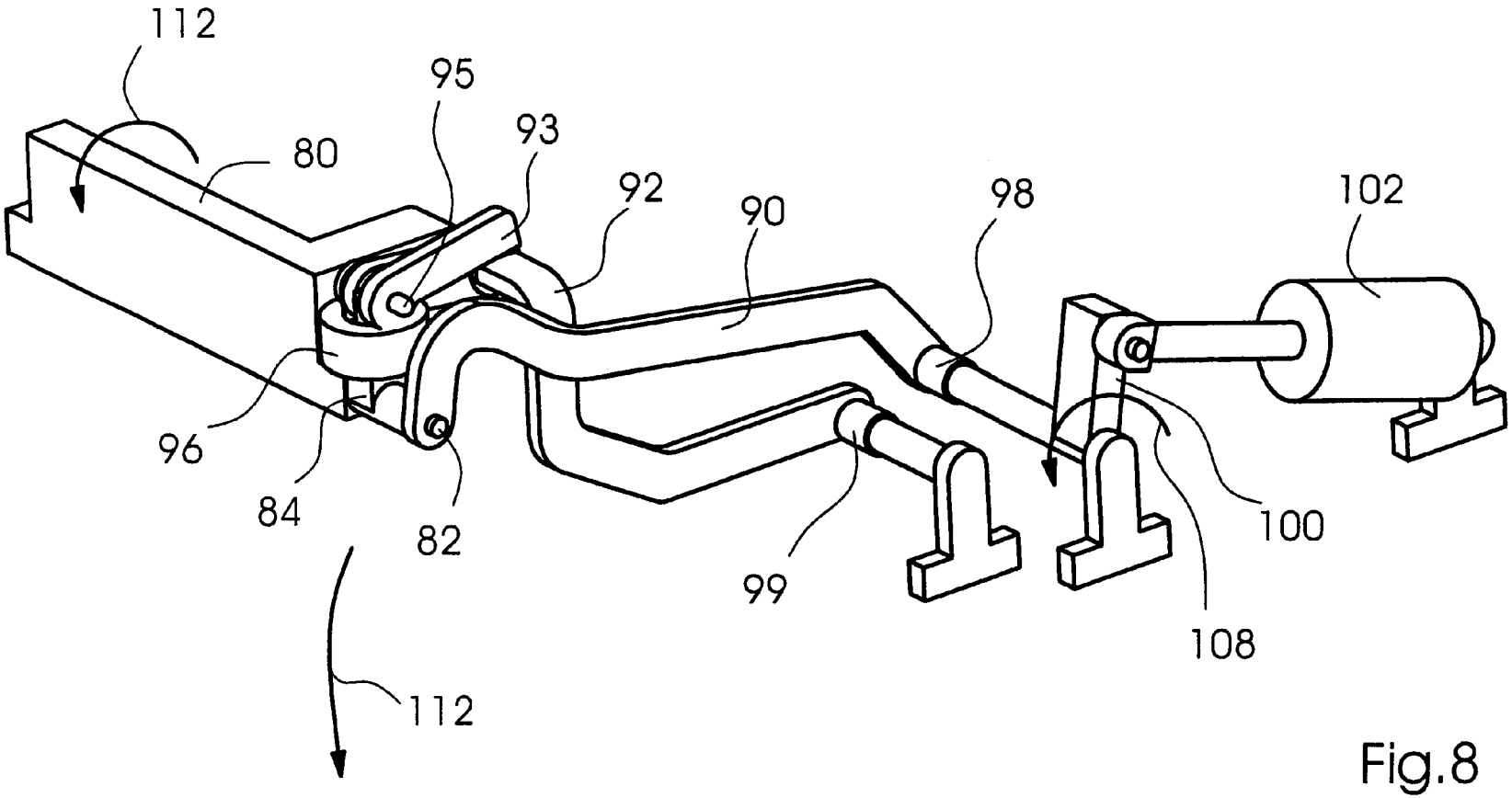
FIG. 8 shows a section of alternate construction for supporting the first and second gripper sets of the present invention.
Figure 9:
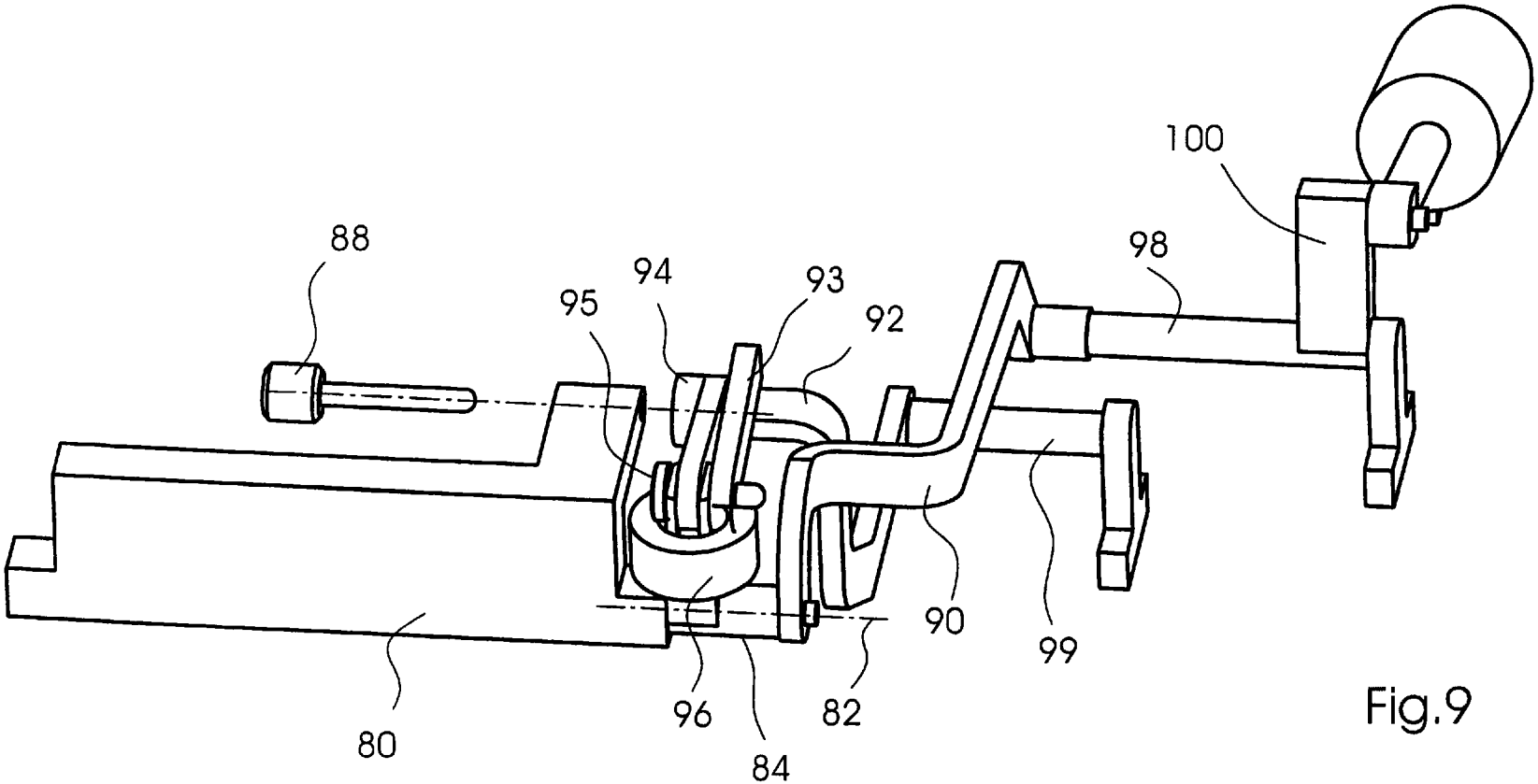
FIG. 9 shows schematically the details of the construction of FIG. 8.
Figure 10:
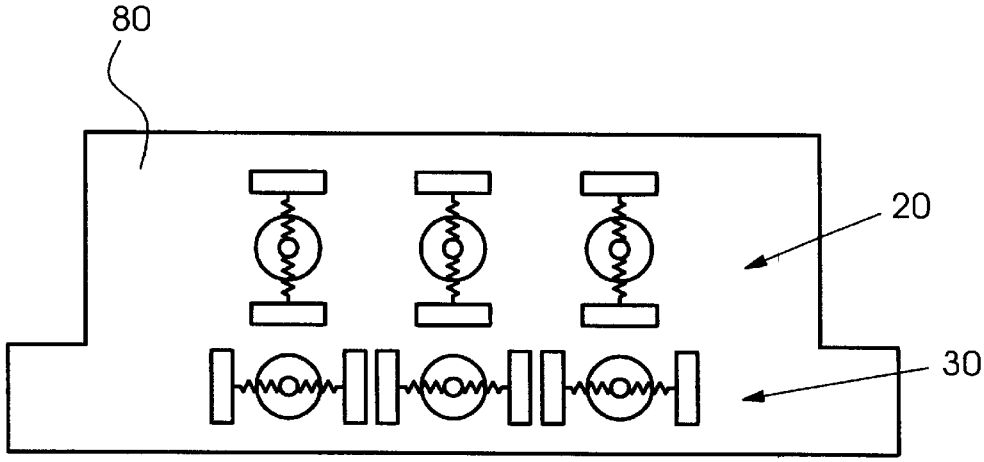
FIG. 10 shows a possible positioning of the first and second gripper sets with the alternate construction of FIG. 8.

Another alternative to the gripper movement mechanisms shown in FIG. 1 is a bar mechanism as shown in FIGS. 8 and 9. The two gripper sets 20 and 30 may be supported on a gripper support 80, the second gripper set 30 for example being located below first gripper set 20, as shown in FIG. 10.

Support 80 is connected at its bottom end to an air cylinder support 84 and a first arm 90 of the bar mechanism by a pivot 82. Support arm 80 is connected at its top end by a pivot 88 (FIG. 9) to one side of a lever 94 of the bar mechanism. The other side of lever 94 is attached to an end 93 of a second arm 92 by a pivot 95. Pivot 95 in turn is connected to an air cylinder 96 supported on air cylinder support 84.

Arms 90 and 92 are rotatably supported in, for example, a frame at ends 98 and 99, respectively. An activating arm 100 for arm 90 is connected at one end to end 98 and an air cylinder 102 is connected to the other end of activating arm 100.

A similar bar mechanism is located on the other side of support 80.

The bar mechanism operates as follows. First gripper set 20 grips a plate from a plate supply. Air cylinder 102 is actuated, which rotates arm 90 about end 98 as shown by arrow 108. Thus gripper support 80 is rotated downwardly in the direction of arrow 110 so that the plate bumps and aligns against a blanket. The plate is then gripped by the second gripper set 30, and released by first gripper set 20. Air cylinder 96 then is actuated, causing gripper support 80 to rotate in the direction of arrow 112, thus moving the plate edge against the locking bar of the plate cylinder. Upon a further movement of the gripper support 80, the plate springs into the gap in the plate cylinder and is aligned axially, for example through moving the entire bar mechanism axially. The lock-up mechanism in the plate cylinder is then activated and the plate released from second gripper set 30.

In addition to being used to move the plate into the plate cylinder gap, the second air cylinder may also be activated to aid in gripping new plates from a new plate supply.

Plate cylinder 2 may be a small-gapped plate cylinder, which is defined herein to mean that the receiving gap is less than 0.25 inches. While the present invention has been described using the blanket cylinder for alignment purposes, it may also be possible to use another cylinder adjacent to the plate cylinder, for example an ink roller, to align the printing plate before insertion. The blanket cylinder preferably includes a gapes blanket. A gripper set as defined herein means at least one gripper capable of supporting the printing plate when activated.

What is claimed is:

1. A method for automatically providing a printing plate to a plate cylinder comprising the steps of:

aligning a first edge of a printing plate against an adjacent cylinder adjacent to a plate cylinder by having the first edge of the printing plate contact the adjacent cylinder;

moving the first edge of the printing plate into a gap in the plate cylinder; and wrapping the printing plate about the plate cylinder.

2. The method as recited in claim 1 wherein the first edge is a lead edge of the printing plate.

3. The method as recited in claim 1 further comprising fastening the first edge in the gap.

4. The method as recited in claim 1 wherein the wrapping step includes rotating the plate cylinder so that the printing plate passes through a nip formed between the printing plate and the adjacent cylinder.

5. The method as recited in claim 1 further comprising tucking a second edge of the printing plate into the gap.

6. The method as recited in claim 1 wherein the adjacent cylinder is a blanket cylinder.

7. The method as recited in claim 1 wherein the plate cylinder is a small-gapped plate cylinder.

8. The method as recited in claim 1 wherein the aligning step includes holding a printing plate through a first set of grippers and moving the first set of grippers so that a lead edge of the plate aligns against the adjacent cylinder and the moving step includes holding the printing plate through a second set of grippers, releasing the first set of grippers, and moving the second set of grippers toward the gap.

9. A device for attaching a printing plate to a plate cylinder comprising:

a first set of grippers gripping a printing plate and aligning the printing plate against an adjacent cylinder adjacent to the plate cylinder by having a first edge of the printing plate contact the adjacent cylinder; and a second set of grippers for moving the printing plate toward a gap in the plate cylinder.

10. The device as recited in claim 9 wherein the first set of grippers are spring mounted so as to be flexible in a direction radial to the adjacent cylinder.

11. The device as recited in claim 9 wherein the first set of grippers includes a track running radially to the adjacent cylinder.

12. The device as recited in claim 9 wherein the second set of grippers includes a track running radially to the plate cylinder.

13. The device as recited in claim 9 further comprising a tucking device.

14. The device as recited in claim 9 wherein the first set of grippers includes at least two grippers.

15. An offset printing press comprising:

a plate cylinder with a plate locking mechanism and an outer surface of the plate cylinder having a receiving gap;

a blanket cylinder forming a nip with the plate cylinder, and a plate attachment device having a first set of grippers for gripping a printing plate and aligning the printing plate against the blanket cylinder and a second set of grippers for moving the printing plate toward the receiving gap, an edge of the printing plate contacting the blanket cylinder to align the printing plate.

16. The device as recited in claim 15 wherein the first set of grippers are spring mounted so as to be flexible in a direction radial to the blanket cylinder.

17. The device as recited in claim 9 wherein the second set of grippers includes a track running radially to the plate cylinder.

18. The device as recited in claim 15 wherein the second set of grippers includes a track running toward the plate cylinder.

* * * * *